United States Patent [19]

Barolin

[11] 4,344,259

[45] Aug. 17, 1982

[54] ROCKER ARM AND PIN HOLDER ASSEMBLY FOR A LENS SURFACING MACHINE

[76] Inventor: Nestor E. Barolin, 39 Eight St., Hicksville, N.Y. 11801

[21] Appl. No.: 171,014

[22] Filed: Jul. 21, 1980

[51] Int. Cl.[3] ..... B24B 13/02

[52] U.S. Cl. ..... 51/216 LP; 51/124 L

[58] Field of Search ..... 51/58, 124 L, 216 LP, 51/217 L

[56] References Cited

U.S. PATENT DOCUMENTS 2,977,724 4/1961 Kennedy ..... 51/124 L 4,143,490 3/1979 Wood ..... 51/58

*Primary Examiner*—Harold D. Whitehead

*Attorney, Agent, or Firm*—Bauer & Amer

[57] ABSTRACT

The pin holder has at least one vertical projection which fits in mating relationship against the flat front faces of the lateral lugs of the rocker arm. Shims are inserted between the projection and the lateral lugs. Fastening means extending through said projection into said lugs in a direction perpendicular to the axis defined by the pins held by the pin holder, maintains the alignment of said pins in the horizontal plane which includes the axis of oscillation of the polishing lap.

4 Claims, 3 Drawing Figures

ROCKER ARM AND PIN HOLDER ASSEMBLY FOR A LENS SURFACING MACHINE

BACKGROUND OF THE INVENTION

This invention relates to improvements in lens surfacing machines. In particular it relates to an improved rocker arm and pin holder assembly especially for use in producing toric lenses.

In a conventional lens polishing machine the lens to be polished is supported on a block and is pressed into contact with the polishing lap by a pair of pins which are engaged in recesses in the lens support block, the pins being carried by a pin holder attached to a rocker arm. Misalignment of the pins out of a horizontal plane which includes the axis of the oscillation of the polishing lap can result in errors in the finished lens, it thus being required that the pins be supported immovably and in extremely accurate alignment in the said axis. The axis of the lens must be kept in line with the axis of the oscillating polishing lap.

In the known constructions, the pin holder is attached to the rocker arm by a single bolt. Bolts carried by lugs on the pin holder are engaged in lateral sides of the rocker arm and are adjusted separately to bring the points of the pins into the required horizontal plane.

A disadvantage of the known construction is that vibration or impact shock can cause movement of the pin holder relatively to the rocker arm with consequential misalignment of the pins.

Therefore the object of the invention is to provide a rocker arm and pin holder assembly for a lens surfacing machine which will maintain an undeviating axis alignment during operation of the machine.

Another object of the invention is to provide a rocker arm and pin holder assembly with means for perfectly aligning the axis.

SUMMARY OF THE INVENTION

The above objects are attained by providing the rocker arm with a pair of extremely rigid lateral lugs having flat substantially vertical front faces. Fastening means maintains a mating relationship between the flat front faces of the rocker arm lugs and at least one vertical projection on the support for the lens holding means, e.g., a pin holder. The fastening means extends in a direction roughly perpendicular to the axis defined by the holding means, e.g. pins, instead of in a parallel direction as in the conventional holder. Shims are inserted between the lugs and the vertical projection in order to bring the lens holding means into the required horizontal plane. Once the fastening means are tightened, the pin holder is held immovably relative to the rocker arm.

DETAILED DESCRIPTION OF THE DRAWING

Figure 1:
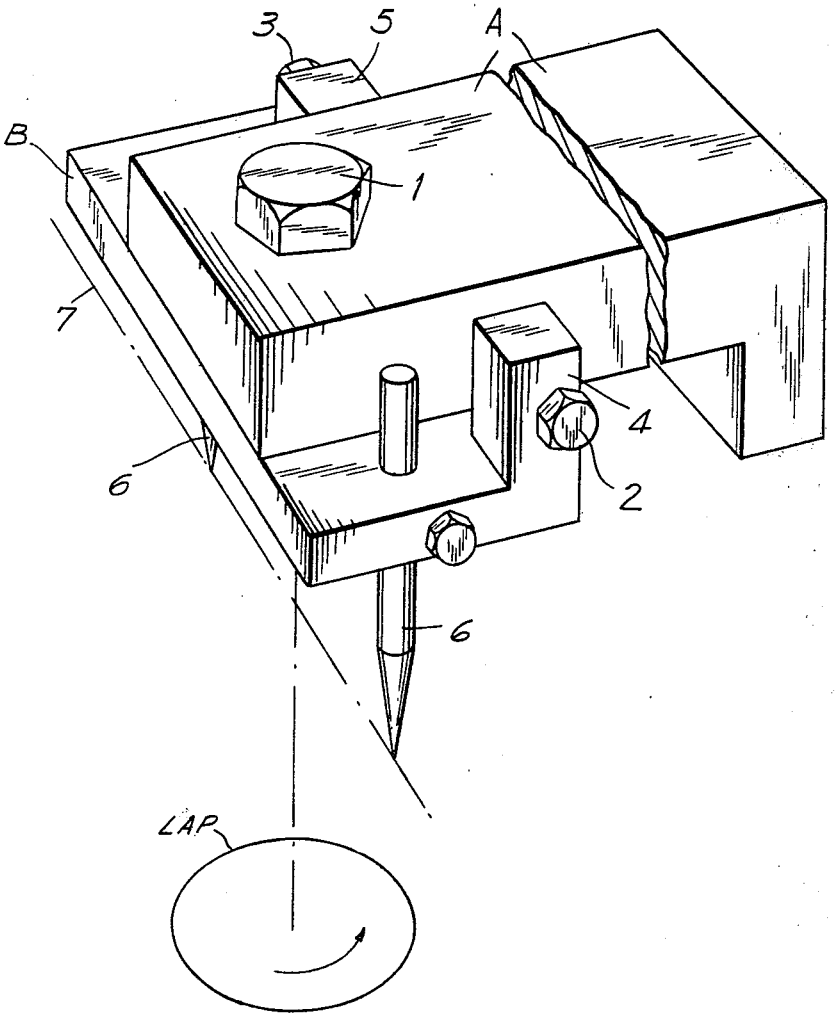
FIG. 1 (PRIOR ART)
FIG. 1 is a perspective view of a conventional rocker arm and pin holder assembly.

The prior art assembly as illustrated in FIG. 1 comprises a rocker arm A and a pin holder B. The pin holder B is attached to the rocker arm A by a single bolt 1. Bolts 2 and 3 carried by lugs 4 and 5 on the pin holder B are engaged in the lateral sides of the rocker arm, and are adjusted separately to bring the points of the pins 6 into the required horizontal plane 7.

Figure 2:
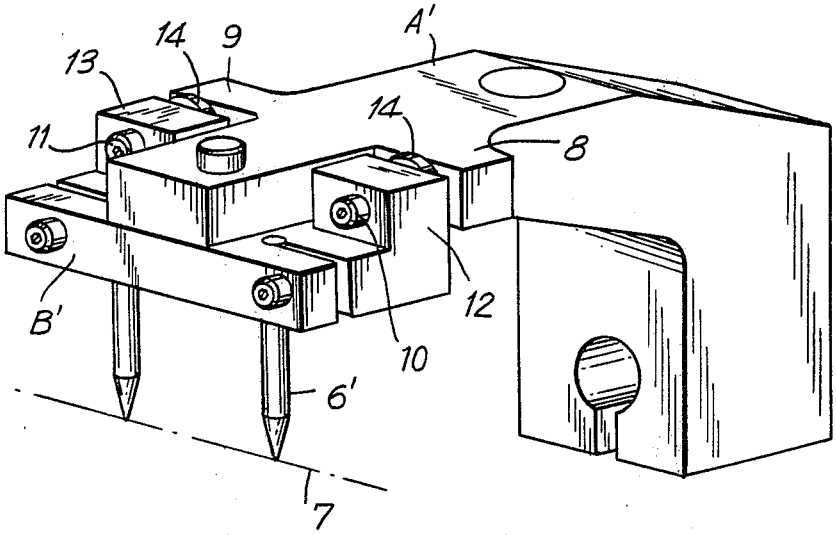
FIG. 2 is a perspective view of one embodiment of the rocker arm and pin holder assembly according to the invention.

In the embodiment of the assembly according to the invention as illustrated in FIG. 2, the rocker arm A′ is provided with a pair of rigid lateral lugs 8 and 9. Bolts 10 and 11 extend through lugs 12 and 13 of the pin holder B′, the bolts being received in tapped bores in lugs 8 and 9. Shims 14 are inserted between lugs 8 and 12 and between lugs 9 and 13 to bring the pins 6′ into the required horizontal plane 7′.

Figure 3:
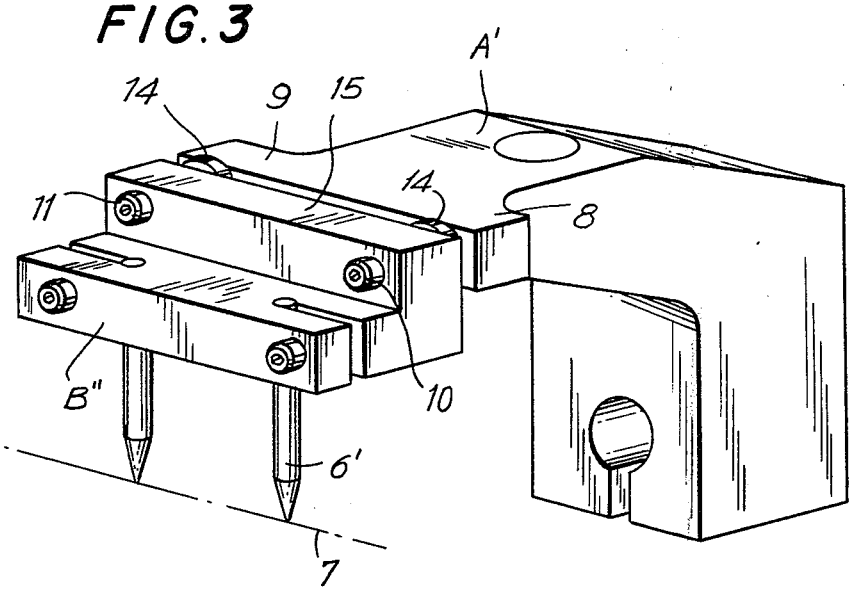
FIG. 3 is a perspective view of another embodiment of the rocker arm and pin holder assembly according to the invention.

In the embodiment of the assembly according to the invention as illustrated in FIG. 3, the lugs 13 and 12 are replaced by a continuous bar 15. The rest of the construction is the same.

The basic difference in concept between the invention and the prior art resides in that essentially incompressible and dimensionally stable shims 14 are substituted for the misalignment-prone bolts 2 and 3 of the known construction, the bolts 10 and 11 acting in unison to exert a compressive force on the shims, as opposed to being employed as a micrometer device for adjusting the pin holder angularly about the main single support bolt 1.

I claim:

1. In a rocker arm assembly for use in a lens grinding machine for producing toric lenses in which the rocker arm assembly includes a rocker arm that is movable relative to the lap axis of the lens grinding machine, the improvement comprising said rocker arm having a planar projection with a flat face normally disposed substantially vertical and extending horizontally outward from the lateral sides thereof, a support having a flat face normally disposed substantially vertical and extending horizontally in facing relationship with said flat faces of said rocker arm, fastening means engaging said rocker arm and said support for releasably maintaining at least the flat face of said support in substantial vertical facing with and to adjust the same in spaced relationship from the faces of said rocker arm and for adjustment of said support about an axis perpendicular to the plane of said rocker arm projection, and a plurality of relatively spaced lens engaging means on said support.

2. The assembly according to claim 1, wherein said projection comprises a continous horizontally extending bar and said flat faces are formed thereon.

3. The assembly according to claim 1, wherein said flat faces of said rocker arm extend horizontally outward from lateral sides and intermediate the ends of said projection to form a pair of relatively spaced lugs in which said fastening means engage.

4. The assembly as in any one of claims 1 or 3, and means between said flat faces of said rocker arm and support means to maintain said faces in their spaced relationship.

* * * * *